US006135832A

United States Patent [19]

Suzuki

[11] Patent Number: 6,135,832

[45] Date of Patent: Oct. 24, 2000

[54] PROPULSION SYSTEM FOR PERSONAL WATERCRAFT

[75] Inventor: Akitaka Suzuki, Iwata, Japan

[73] Assignee: Yamaha HatsudokiKabushiki Kaisha, Iwata, Japan

[21] Appl. No.: 09/183,527

[22] Filed: Oct. 30, 1998

[51] Int. Cl.[7] ..... B63H 23/24

[52] U.S. Cl. ..... 440/83; 440/75

[58] Field of Search ..... 114/55.5, 55.58; 440/38, 75, 83, 111

[56] References Cited

U.S. PATENT DOCUMENTS 5,846,102 12/1998 Nitta et al. ..... 440/111

*Primary Examiner*—Ed Swinehart

*Attorney, Agent, or Firm*—Knobbe, Martens, Olson & Bear LLP

[57] ABSTRACT

Several embodiments of personal watercraft having very compact construction, in particularly embodying a compact propulsion system wherein the engine and a number of its accessories all define a very compact area. This permits the center of gravity to be located at the desired location and maintain good balance for the watercraft regardless of the number of passengers who occupy it.

17 Claims, 6 Drawing Sheets

PROPULSION SYSTEM FOR PERSONAL WATERCRAFT

BACKGROUND OF THE INVENTION

This invention relates to a personal watercraft and more particularly to an improved propulsion system for such watercraft.

Personal watercraft represent a very rapidly growing segment of the total watercraft market. Although personal watercraft have a wide variety of features and configurations, they have in common the fact that they are designed primarily to have a hull that is quite small and which accommodates a rider and no more than a few additional passengers. Frequently, but not always, the rider and passenger sit on a straddle type seat and in tandem fashion. With this type of watercraft, the riders' area is generally positioned at the rear of the watercraft.

This type of watercraft is also commonly propelled by a so-called "water jet propulsion unit" that is generally mounted in the hull under surface at the rear of the watercraft and generally underline the rearward portion of the riders' area.

This type of construction, particularly in a small watercraft, provides a significant rearward weight bias. Therefore, it is desirable and has been the practice to mount the engine for the propulsion device in a generally forward position and so that it lies at least in part beneath the forward portion of the riders' area. Thus, the center of balance of the watercraft can be optimized and can accommodate varying numbers of riders without the balance being significantly upset.

This gives rise, however, to a problem such as accessibility of the engine for servicing. Also, as these watercraft become more sophisticated, there are a number of accessories that are associated with the engine and which have a driving relationship with it. These may be electrical generators, electric starters, pumps for pumping liquids such as fuel and/or oil for the engine and other accessories such as balance shafts.

In order to maintain the desired weight balance and accessibility, it is very difficult to accommodate all of these accessories. In addition, the engine is provided with an induction system for delivering at least an air charge to the combustion chambers of the engine for mixing with the fuel and combustion in the combustion chambers. In addition, an exhaust system should be provided for discharging the exhaust gases from the engine to the atmosphere and also which includes an arrangement for ensuring that water cannot enter the engine through this exhaust system. Thus, there are a fairly substantial number of components associated with the propulsion system that must be located in the watercraft to maintain the balance and permit accessibility.

It is, therefore, a principle object of this invention to provide an improved propulsion system for a watercraft of the personal type which will have a compact nature and which will maintain good balance, accessibility of the engine components for servicing, and maintaining the accessories in close proximity to the engine so as to not upset the balance and to avoid drive problems for driving the accessories or maintaining the driving relationship between the accessories and the engine output shaft.

It is a further object of this invention to provide an improved and compact propulsion system for a personal watercraft.

SUMMARY OF THE INVENTION

The features of this invention are adapted to be embodied in a personal watercraft and propulsion system therefor. The personal watercraft is comprised of a hull that defines a rider's area at the rear thereof for accommodating a rider and a minimum number of passengers. A jet propulsion system is supported in the hull at the rear end thereof and at least in substantial part beneath the riders' area. An internal combustion engine is supported within the hull at a position disposed forwardly of the jet propulsion unit and at a position that is at least in part below the forward portion of the riders' area. The engine has a plurality of cylinders and a crankshaft driven by pistons that reciprocate in the cylinders and which is defined an engine body. The engine drives the jet propulsion unit through a transmission system.

In accordance with a first feature of the invention, an accessory for the engine is driven by the crankshaft through a transmission which, along with the accessory, is contained within the engine body.

In accordance with another feature of the invention, the crankshaft is positioned in the hull so that it rotates about an axis that is disposed transversely to the longitudinal center line of the hull.

DETAILED DESCRIPTION OF THE PREFERRED EMBODIMENTS OF THE INVENTION

Figure 1:
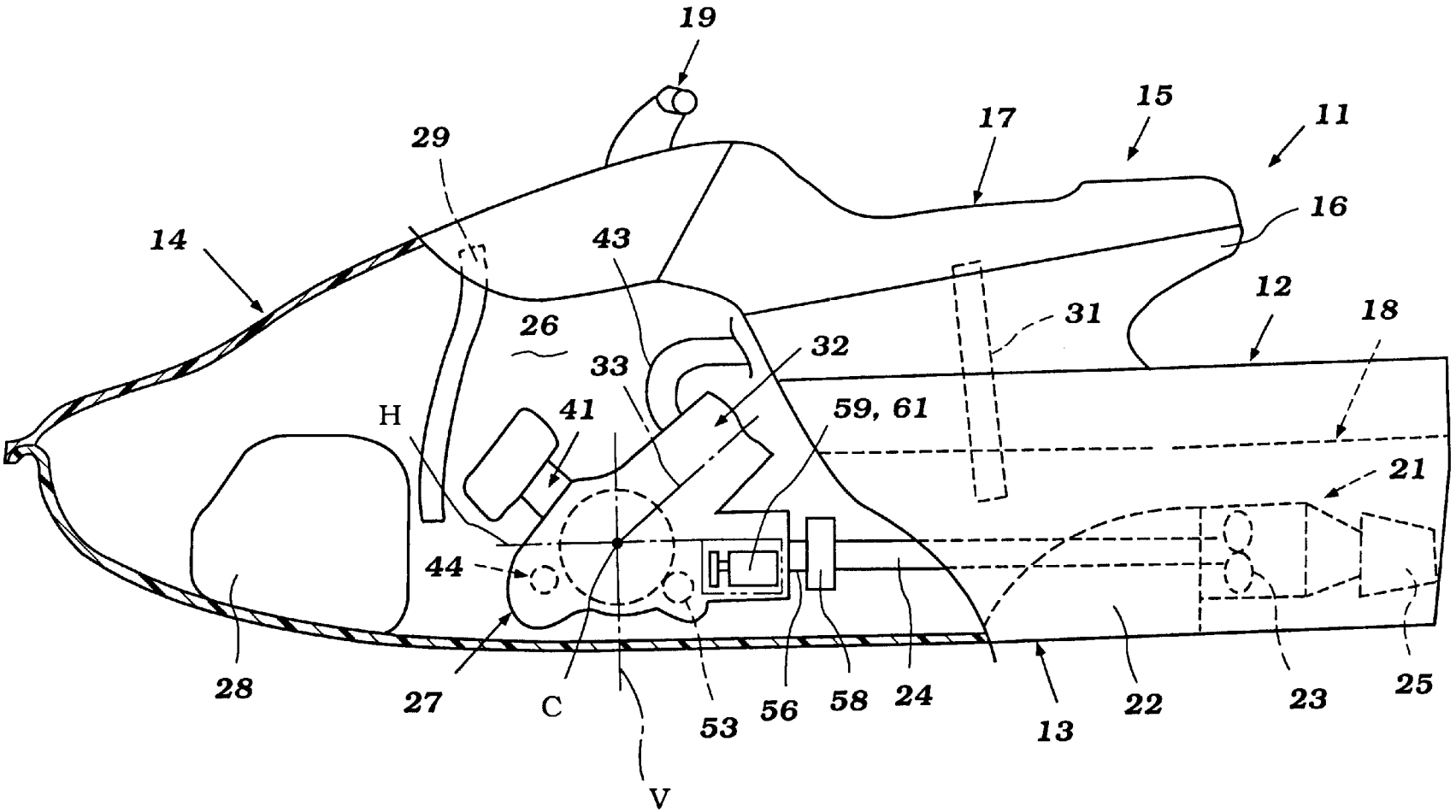
FIG. 1 is a side elevational view of a personal watercraft having a propulsion unit constructed in accordance with a first embodiment of the invention, with portions of the hull broken away so as to more clearly show the orientation of the engine and its accessories in the watercraft.
Figure 2:
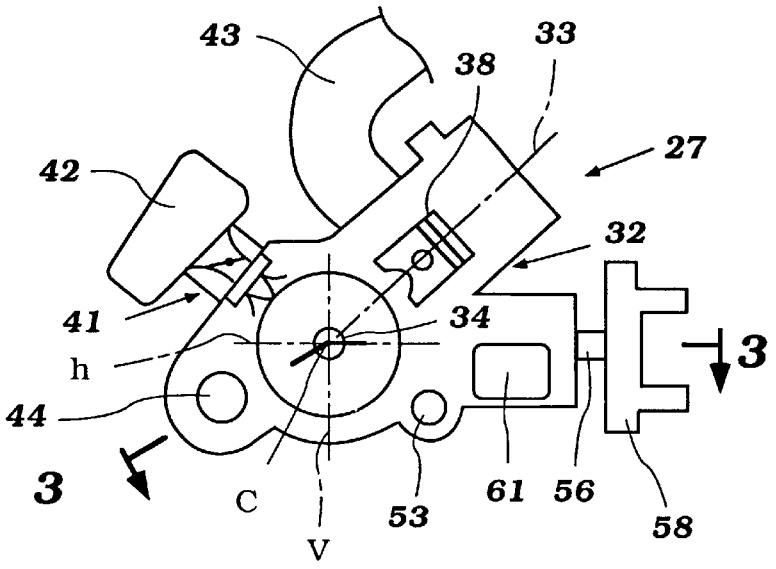
FIG. 2 is a side elevational view looking in the same direction as FIG. 1 and shows only the engine and additional portions of the engine in schematic cross-section.
Figure 3:
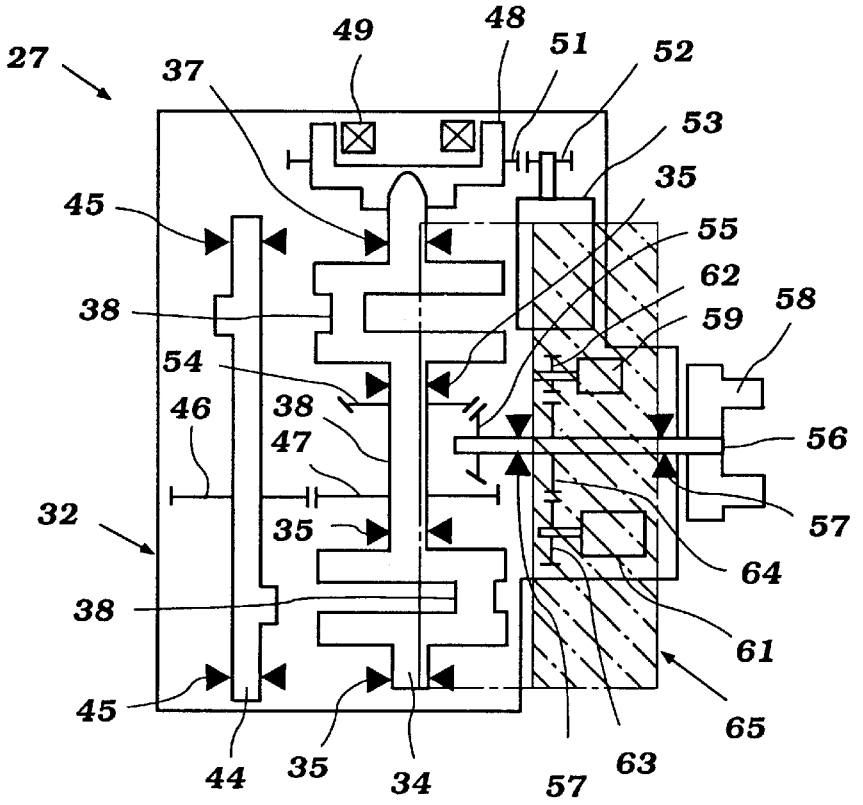
FIG. 3 is a schematic, cross-sectional view taken generally along the line 3—3 of FIG. 2.

Referring now in detail to the drawings and initially to the embodiment of FIGS. 1–3, a small personal watercraft constructed and propelled by a propulsion device embodying the invention is indicated generally by the reference numeral 11. As has been aforenoted, the personal watercraft 11 is of a type that is designed to be operated primarily by a rider and is designed to carry one or more additional passengers, although the number to be accommodated is relatively small. In this particular instance, the total maximum number of occupants of the riders' area of the watercraft 11, is approximately three. Also, the particular configuration of the riders' area, which will be described, is to be considered to be only typical of one of many types of configurations that are used and which are typical with this type of watercraft and with which the invention may be practiced.

The watercraft 11 is comprised of a hull assembly, indicated generally by the reference numeral 12 which is comprised of a hull under part 13 and a deck portion 14. The hull portions 13 and 14 are formed from a suitable material, such as a molded, fiberglass reinforced resin or the like, and are secured together in any suitable manner.

The deck portion 14 defines at the rear end thereof a riders' area, which has been previously referred to and which is indicated generally by the reference numeral 15. This is comprised of a raised pedestal part 16 on which a removable seat cushion part 17 is detachably supported. The seat 17 is sized so as to accommodate the aforenoted operator and one or more riders who are seated in straddle cabin fashion. The riders feet are placed in foot areas 18 disposed on opposite sides of the pedestal part 16.

A control mast 19 is disposed forwardly of the seat 17 for control of the watercraft by the rider operator in a well known manner.

The hull 12 defines an undersurface in which a jet propulsion unit, indicated generally by the reference numeral 21 is mounted. The jet propulsion unit 21 is mounted toward the rear of the riders' area 15 and on the underside of the hull portion 13 at the rear of the watercraft.

As is typical, the jet propulsion unit 21 includes an outer housing that defines a downwardly facing water inlet portion 21 through which water may be drawn for propulsion of the watercraft 11. This water is drawn by an impeller 23 that is journaled within the outer housing of the jet propulsion unit 21 and which is driven by an impeller shaft 24 that extends forwardly beneath the riders' area 15.

A steering nozzle 25 is journaled for steering movement about a vertically extending axis at the end of the jet propulsion unit outer housing. By pivoting this steering nozzle 25 about this axis through operation of the control mast 19, the watercraft may be steered in a manner well known in the art An engine compartment 26 is formed by the hull and deck portions 13 and 14 generally forwardly of the jet propulsion unit 21 and in substantial part beneath the forward portion of the riders' area 15. A propulsion drive unit, indicated generally by the reference numeral 27, is mounted within this engine compartment 26 rearwardly of a fuel tank 28 for driving the jet propulsion unit 21 in a manner which will be described.

The engine compartment 26 is ventilated by a ventilating air inlet pipe 29 mounted at the front thereof and which draws atmospheric air for circulation through the engine compartment 29. A discharge vent pipe 31 extends upwardly from the rearward portion of the engine compartment 26 and beneath the seat 17 for discharge of the ventilating gases back to the atmosphere.

The invention deals primarily with the construction of the propulsion drive unit 27 and its manner of driving connection to the impeller shaft 24. This construction may be best understood by reference additionally to FIGS. 2 and 3.

The propulsion unit 27 in this embodiment is comprised of a two cylinder in-line type engine operating on a two stroke crankcase compression principle. It is to be understood, of course, that the invention can be utilized with other types of engines. However, the invention has particular utility with engines of this type and particularly engines that employ balance shafts, for reasons which will become apparent.

The engine is comprised of a cylinder block assembly 32 that has two in-line cylinder bores that lie on a common plane 33 which is inclined at an acute angle to a horizontal plane H passing through the center of rotation C of a crankshaft 34 that is journaled within a crankcase chamber as shown somewhat schematically in FIG. 3. A vertical plane V passes through the axis of rotation C. The cylinder bore axes common plane 33 is inclined at a rearward acute angle to this vertical plane V.

The crankshaft 34 is supported by a plurality of longitudinally spaced main bearings which are shown schematically at 35 and which are basically positioned at the ends of the crankshaft 34 and between the throws 38 thereof.

Figure 4:
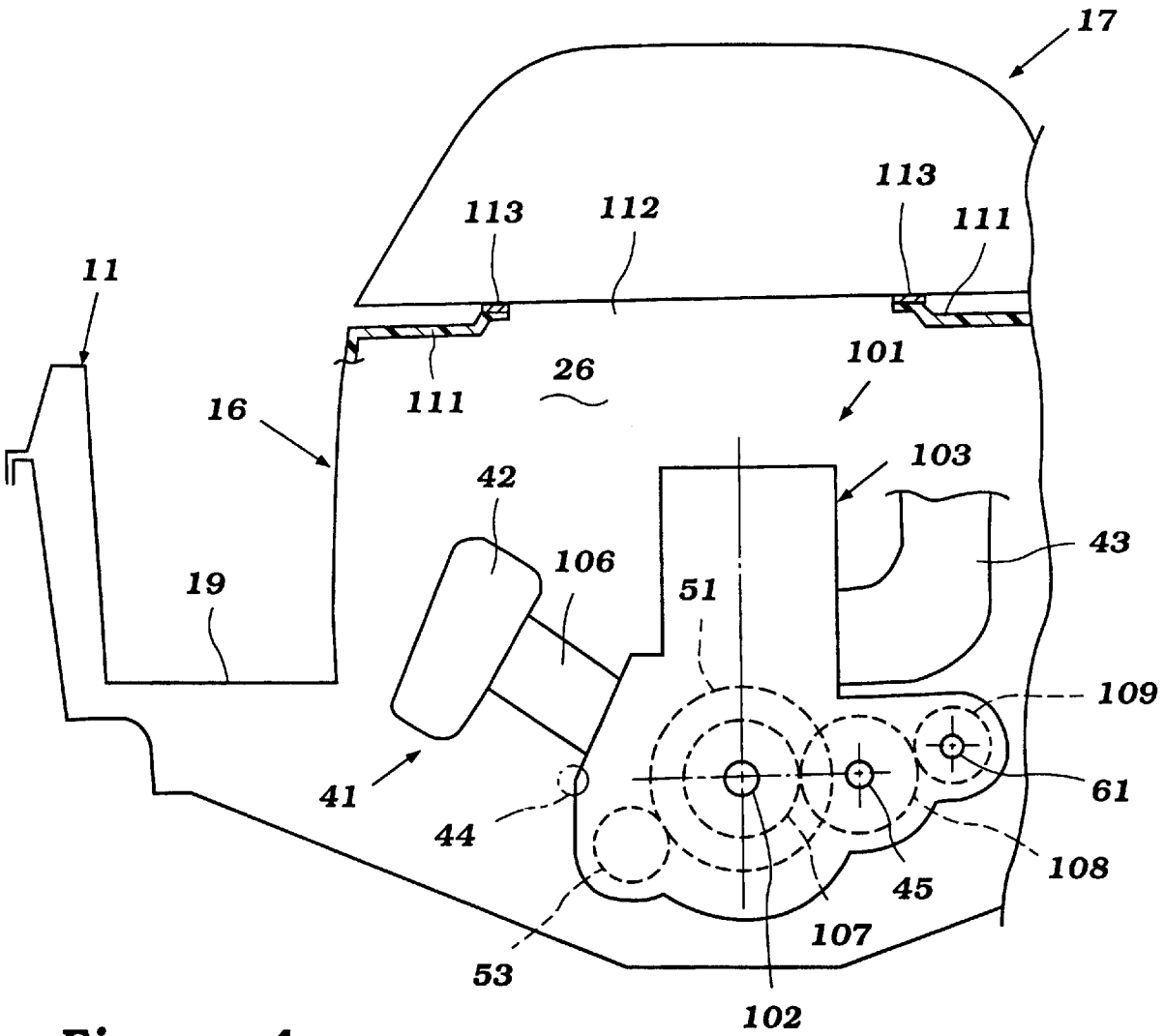
FIG. 4 is a transverse cross-sectional view taken through a personal watercraft constructed in accordance with a second embodiment of the invention.
Figure 5:
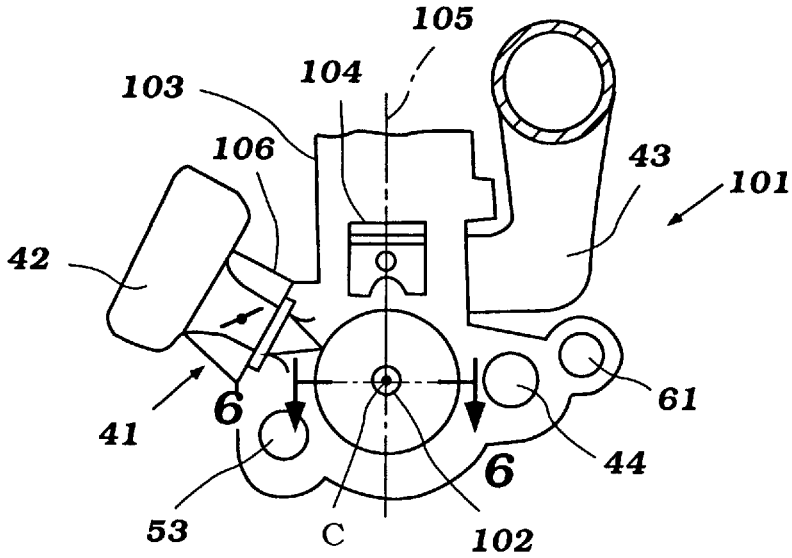
FIG. 5 is a view of the engine of this embodiment looking in the same direction as FIG. 4 and is, in part, similar to FIG. 2 in that it shows additional of the internal components of the engine in schematic cross-section.
Figure 6:
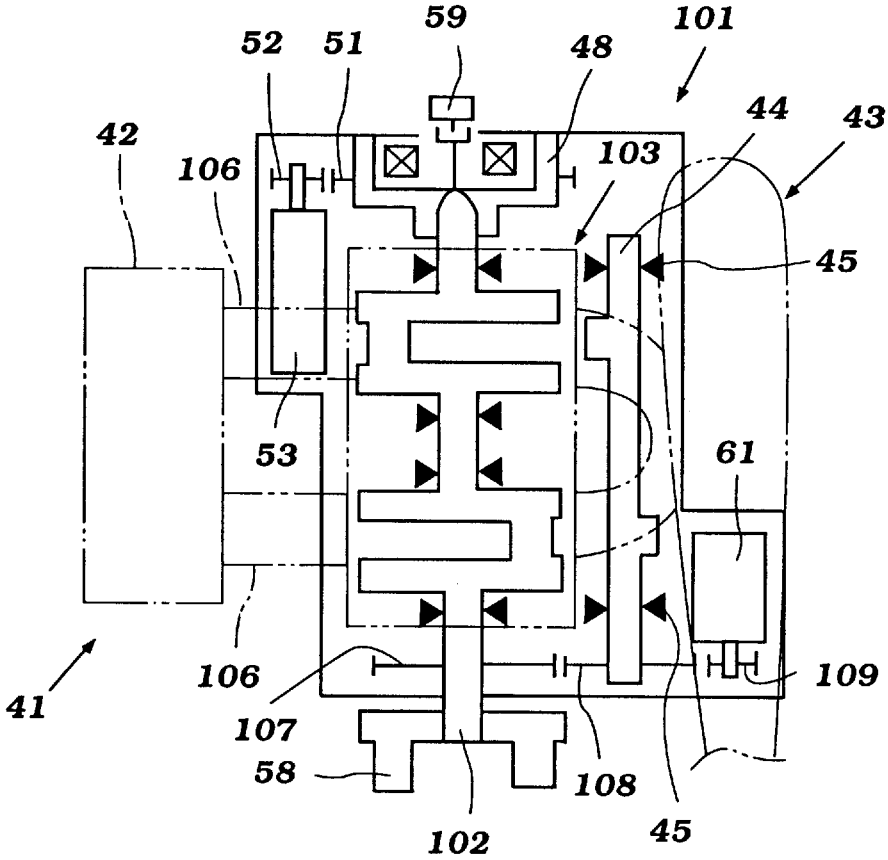
FIG. 6 is a cross-sectional view taken along the line 6—6 of FIG. 5 and thus is, in part, similar to FIG. 3.

Pistons 39 reciprocate in the respective cylinder bores and are connected by connecting rods which are not shown, but which can have any known type of conventional structure, to the crankshaft throws 38 for driving it for rotation about the axis C. As noted, this axis C extends transversely to the vertically extending plane V that intersects the horizontal plane H and which is disposed beneath the forwardmost end of the riders' area 15. The engine 27 is accessible for servicing through an access opening in the deck portion 14, as will be described in a later embodiment (FIGS. 4–6).

The basic construction of the components of the engine which are conventional are not illustrated as those skilled in the art will readily understand how the invention can be practiced. However, the layout of the accessory drives and drive for driving the impeller shaft 24 and certain accessories associated with the engine are important and these will be described.

As is typical with two cycle crankcase compression engine practice, an induction system, indicated generally by the reference numeral 41, is provided for supplying at least an air charge to the crankcase chambers associated with each of the cylinder bores in which the pistons 39 reciprocate. The crankcase assembly is arranged so that each chamber section associated with a cylinder bore is sealed from the other. This induction system 41 includes an air inlet device 42 that draws air from within the engine compartment 26 and specifically air that is admitted by the ventilating pipe 29.

As is well known in two cycle practice, the intake charge is compressed in the crankcase chambers and then transferred to the combustion chambers formed above the heads of the pistons 39 by a cylinder head assembly that is affixed to the cylinder block 32 through scavenged passages. The charge is ignited by spark plugs which are not shown, and then discharged through an exhaust system which is shown partially and indicated by the reference numeral 43. This exhaust system 43 may include one or more water trap devices and discharges the exhaust gases to the atmosphere.

A balance shaft 44 is rotatably journaled within the crankcase chamber by spaced bearings 45. A drive gear 46 is affixed to the balance shaft 44 and is driven by a balance shaft drive gear 47 that is formed on one side of one throw of the right side throw 38 of the crankshaft 34. In the illustrated embodiment, the balance shaft 44 is driven at the same speed but in the opposite direction as the crankshaft 34 by this timing arrangement. This construction is all contained within a engine main body that includes the cylinder block 32.

A flywheel 48 is affixed to one end of the crankshaft 34. This flywheel has associated with it a flywheel magneto assembly 49 that generates electricity for charging a battery and/or for firing the ignition circuit afore-referred to for the spark plugs.

In addition, a starter gear 51 is affixed to the peripheral edge of the flywheel 48. A starter pinion 52 associated with a starter motor 53 engages the starter gear 51 for electrical starting of the engine. The starter motor 53 is also contained within the engine body that includes the cylinder block 32.

On the inner side of the left hand throw 38 of the crankshaft and spaced from the balance shaft drive gear 47 there is provided a bevel gear 54. This bevel gear 54 is enmeshed with and drives a driven bevel gear 55 that is fixed to an engine drive shaft 56. This engine drive shaft 56 is mounted within the engine body that includes the cylinder block 32 by means of spaced bearings 57.

A coupling 58 is affixed to the exposed end of the drive shaft 56 and affords an elastic coupling to the forward end of the impeller shaft 24 as shown best in FIG. 1. Thus, the length of the engine in the engine compartment can be substantially reduced by placing the engine 27 in a transverse position with the cylinder bores inclined to the rear. This maintains the center of gravity for the watercraft in the desired location.

A pair of engine accessories comprised of an oil pump 59 and a fuel pump 61 are mounted in the engine body that includes the cylinder block 32 on opposite sides of the drive shaft 56. These accessories have affixed to their input shafts drive gears 62 and 63 which are enmeshed with a drive gear 64 that is affixed to the drive shaft 56. This connection is also provided within the engine body that includes the cylinder block 32. Furthermore, these accessories lie within a shaded area indicated at 65 in FIG. 3 which lies below the cylinder block 32. Thus, the compact arrangement is maintained and these components will be protected but also accessible.

FIGS. 4–6 show another embodiment of the invention which is generally the same as the embodiment of FIGS. 1–3, except for the construction of the engine propulsion unit, indicated generally by the reference numeral 101, and its orientation within the engine compartment 26. Because of the similarities of certain components to the embodiments thus far described, where those components are the same, they have been identified by the same reference numerals and will not be described again, except insofar as it is necessary to understand the construction and operation of this embodiment.

The primary difference between this embodiment is that the power unit 101 is disposed so that its crankshaft, indicated generally by the reference numeral 102, rotates about a longitudinally extending axis, also indicated at C, which is generally aligned with a longitudinal center plane of the watercraft hull 12. The engine 101 again has an engine body 103 which includes a cylinder block portion that defines two aligned cylinder bores in which pistons 104 are mounted. The axis 105 of the cylinder bores is vertically disposed in this embodiment.

In this embodiment, the drive coupling 58 for coupling to the drive shaft is directly affixed to the rear end of the crankshaft 102. The flywheel magneto assembly 48 is again fixed to the opposite, in this case front end of the crankshaft. Thus the starter motor 53 has a pinion gear 52 that cooperates with a ring gear 51 fixed to the flywheel magneto assembly.

In this embodiment, however, the oil pump 59 is directly driven off of the nose end of the crankshaft 102.

As may be seen, the induction system 41 is disposed at one side of the engine with the air inlet device 42 extending along this side and serving the engine through throttle bodies, indicated at 106.

The balance shaft 44 is again driven from the crankshaft, but in this instance by a crankshaft drive gear 107 that is affixed adjacent the coupling 58 but within the engine body 103. This drives a gear 108 fixed to the corresponding end of the balance shaft 44. Alternatively, the balance shaft 44 may be located on the opposite side as shown in phantom in FIG. 4.

In this embodiment, the fuel pump 61 is driven from the balance shaft drive gear 108 by means of a gear 109 fixed to its input shaft.

With this arrangement, the exhaust system 43 is disposed at the side of the engine and overlies the fuel pump 61.

FIG. 4 shows a feature which is present in the embodiment of FIGS. 1–3 and which has been referred to therein but which is not illustrated. This is that the raised portion 16 of the hull has a horizontally extending surface 111 upon which the seat 17 is mounted. An opening 112 formed beneath this seat affords access to the engine compartment 26. A seal 113 surrounds this opening 112 so as to provide a water tight arrangement for the opening 112.

Figure 7:
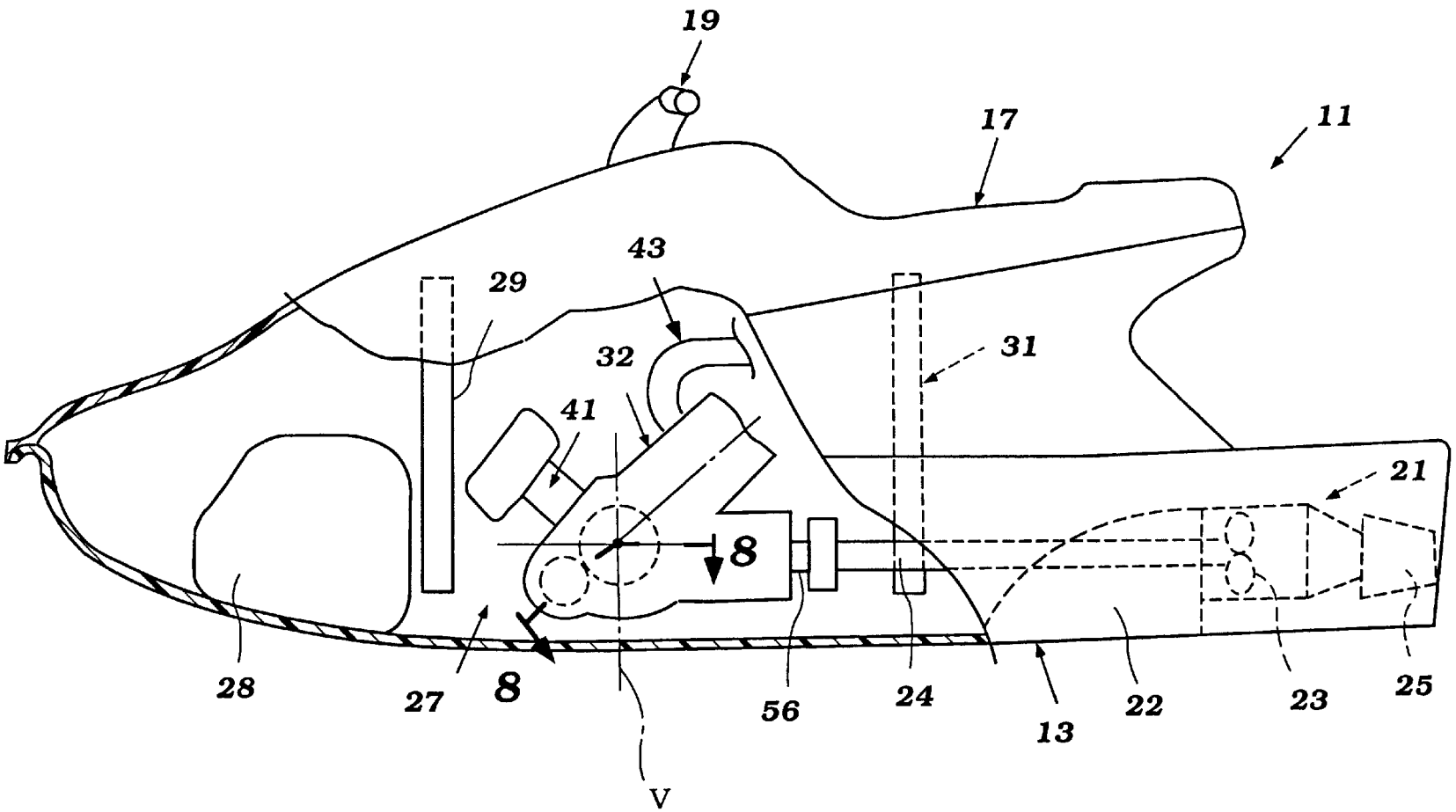
FIG. 7 is a side elevational view, with a portion broken away, in part similar to FIG. 1 and shows a third embodiment of the invention.
Figure 8:
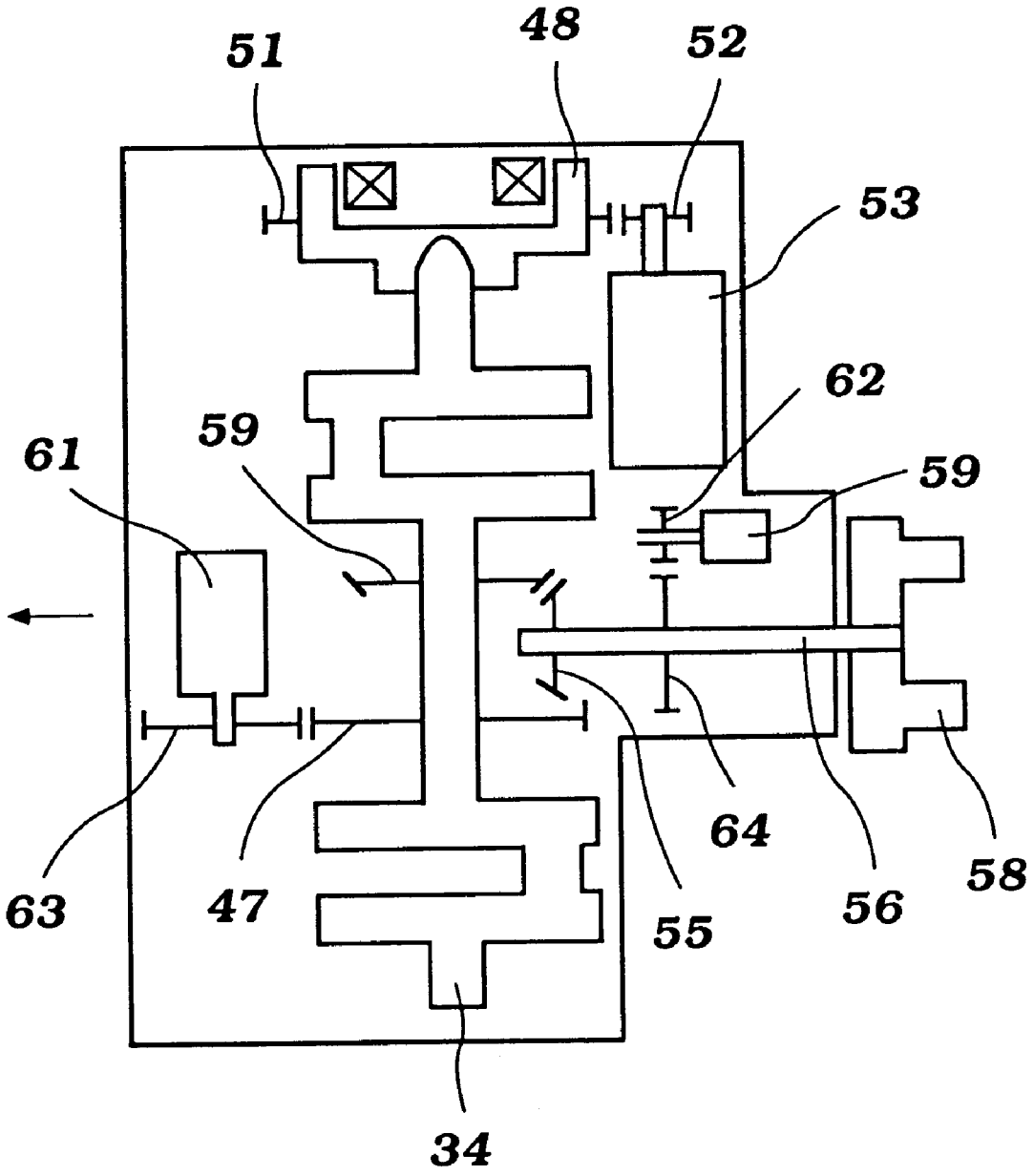
FIG. 8 is a partially schematic cross-sectional view taken along the line 8—8 of FIG. 7.

FIGS. 7 and 8 show another embodiment of the invention which is basically the same as the embodiment of FIGS. 1–3. In this embodiment, however, the balance shaft is eliminated and the balance drive gear 47 on the middle portion of the crankshaft 34 drives the fuel pump 61. Aside from this, this embodiment is the same as that previously described, and, therefore, further description of this embodiment is not believed to be necessary to permit those skilled in the art to practice it.

Thus, from the foregoing description, it should be readily apparent that the described embodiments of the invention provide a very compact propulsion system for a personal watercraft and one which can be conveniently positioned at the desired location in the hull to maintain the desired center of gravity. Because the engine construction is compact in all embodiments, the center of gravity will be maintained even though a different number of riders ride the watercraft.

Of course, the foregoing description is that of preferred embodiments of the invention. Those skilled in the art will readily understand that various changes and modifications can be made without departing from the spirit and scope of the invention, as defined by the appended claims.

What is claimed is:

1. A small personal watercraft and propulsion system therefore comprised of a hull defining a riders' area at the rear thereof for accommodating a rider and a minimum number of passengers, a jet propulsion system suspended in said hull at the rear thereof and lying at least in substantial part beneath said riders' area, an internal combustion engine supported within said hull at a position disposed forwardly of said jet propulsion unit at a position at least in part below the forward portion of said riders' area, a transmission for driving said jet propulsion unit from an output shaft of said engine, said engine having a an engine body defining a plurality of cylinders and a crankshaft driven by pistons reciprocating in said cylinders, and an accessory for said engine driven by said crankshaft through said transmission, said the accessory being contained within said engine body.

2. The small personal watercraft and propulsion system therefore as set forth in claim 1 wherein the engine body includes a cylinder block and further including an induction system for delivering at least an air charge to said engine and an exhaust system for discharging combustion products from said engine.

3. The small personal watercraft and propulsion system therefore as set forth in claim 1 wherein the engine accessory is disposed vertically below at least one of the cylinder block, induction system and exhaust system.

4. The small personal watercraft and propulsion system therefore as set forth in claim 1 wherein there is a second engine accessory for the engine driven by the crankshaft through the transmission, said second accessory also being contained within the engine body.

5. The small personal watercraft and propulsion system therefore as set forth in claim 2 wherein the crankshaft rotates about an axis that extends transversally to a longitudinal center line of said watercraft.

6. The small personal watercraft and propulsion system therefore as set forth in claim 5 wherein the cylinder block is inclined rearwardly from a vertically extending plane.

7. The small personal watercraft and propulsion system therefore as set forth in claim 5 wherein the transmission includes a bevel gear transmission and engine drive shaft driven by said bevel gear transmission and contained within the engine body.

8. The small personal watercraft and propulsion system therefore as set forth in claim 7 wherein the jet propulsion unit includes an impeller shaft and the engine drive shaft is coupled to said impeller shaft.

9. The small personal watercraft and propulsion system therefore as set forth in claim 8 wherein the engine accessory is driven by the engine drive shaft.

10. The small personal watercraft and propulsion system therefore as set forth in claim 9 wherein the engine accessory is driven by the engine drive shaft through a gear transmission.

11. The small personal watercraft and propulsion system therefore as set forth in claim 10 wherein the cylinder block is inclined rearwardly from a vertically extending plane.

12. The small personal watercraft and propulsion system therefore as set forth in claim 2 wherein the crankshaft rotates about an axis that extends along a longitudinal center line of said watercraft.

13. A small personal watercraft and propulsion system therefore comprised of a hull defining a riders' area at the rear thereof for accommodating a rider and a minimum number of passengers, a jet propulsion system having an impeller shaft suspended in said hull at the rear thereof and lying at least in substantial part beneath said riders' area, an internal combustion engine supported within said hull at a position disposed forwardly of said jet propulsion unit at a position at least in part below the forward portion of said riders' area, and a transmission for driving said jet propulsion unit from an output shaft of said engine, said engine having a plurality of cylinders and a crankshaft driven by pistons reciprocating in said cylinders, said crankshaft being journalled within a crankcase of said engine and positioned in said hull so that it rotates about an axis that is disposed transversely to the longitudinal center line of said hull said jet propulsion system impeller shaft rotating about an axis that passes through said crankcase.

14. The small personal watercraft and propulsion system therefore as set forth in claim 13 wherein the transmission includes a bevel gear transmission contained within an engine body that drives the output shaft from the crankshaft.

15. The small personal watercraft and propulsion system therefore as set forth in claim 14 wherein the engine body includes a cylinder block and further including an induction system for delivering at least an air charge to said engine and an exhaust system for discharging combustion products from said engine.

16. The small personal watercraft and propulsion system therefore as set forth in claim 15 wherein the cylinder block is inclined rearwardly from a vertically extending plane.

17. The small personal watercraft and propulsion system therefore as set forth in claim 13 wherein the impeller shaft axis intersects an axis about which the engine crankshaft rotates.

* * * * *